US006788281B2

(12) United States Patent
Ando et al.

(10) Patent No.: US 6,788,281 B2
(45) Date of Patent: Sep. 7, 2004

(54) CIRCUIT PANEL AND FLAT-PANEL DISPLAY DEVICE

(75) Inventors: Kotaro Ando, Fukaya (JP); Yoshiro Aoki, Kitamoto (JP)

(73) Assignee: Kabushiki Kaisha Toshiba, Kawasaki-shi (JP)

( * ) Notice: Subject to any disclaimer, the term of this patent is extended or adjusted under 35 U.S.C. 154(b) by 248 days.

(21) Appl. No.: 09/866,912

(22) Filed: May 30, 2001

(65) Prior Publication Data

US 2002/0000965 A1 Jan. 3, 2002

(30) Foreign Application Priority Data

May 31, 2000 (JP) ..... 2000-163788

(51) Int. Cl.[7] ..... G09G 3/36
(52) U.S. Cl. ..... 345/100; 345/204
(58) Field of Search ..... 345/204, 205, 345/87, 100, 211, 212, 98

(56) References Cited

U.S. PATENT DOCUMENTS 5,574,475 A * 11/1996 Callahan et al. ..... 345/100
6,054,976 A * 4/2000 Kubota et al. ..... 345/100
6,195,077 B1 * 2/2001 Gyouten et al. ..... 345/99
6,292,183 B1 * 9/2001 Yamazaki et al. ..... 345/211
6,462,723 B1 * 10/2002 Yamazaki et al. ..... 345/82

* cited by examiner

*Primary Examiner*—Regina Liang
(74) *Attorney, Agent, or Firm*—Pillsbury Winthrop LLP

(57) ABSTRACT

A circuit panel includes an array substrate in which a scanning line is formed as a capacitive load and first and second scanning line drivers connected to the scanning line in order to commonly drive the scanning line. Each of the first and second scanning line drivers includes first and second switching circuits connected in series between first and second power terminals to selectively output one of the potentials of the first and second power source terminals as a control signal, and an output buffer for setting the potential of the scanning line in accordance with the control signal. The driving abilities of the first and second switching circuits are uneven.

18 Claims, 5 Drawing Sheets

CIRCUIT PANEL AND FLAT-PANEL DISPLAY DEVICE

CROSS-REFERENCE TO RELATED APPLICATIONS

This application is based upon and claims the benefit of priority from the prior Japanese Patent Application No. 2000-163788, filed May 31, 2000, the entire contents of which are incorporated herein by reference.

BACKGROUND OF THE INVENTION

This invention relates to a flat-panel display device in which signal wirings are formed along pixel electrodes arranged in a matrix form and, more particularly to an output circuit connected to an end of the signal wiring to drive the signal wiring, serving as a capacitive load in the flat-panel display device.

In recent years, active matrix type liquid crystal display devices have become popular as monitor displays of notebook-size personal computers and portable terminal devices because of the fine and clear images they can display and the high reliability of the products. Such a liquid crystal display device generally comprises an array substrate having a matrix array of pixel electrodes, a counter substrate having a counter electrode arranged to face the pixel electrodes, and a liquid crystal layer held between the array substrate and the counter substrate. The array substrate includes a plurality of scanning lines arranged along the rows of the pixel electrodes, a plurality of signal lines arranged along the columns of the pixel electrodes and a plurality of switching elements arranged near the intersections of the scanning lines and the signal lines in addition to the plurality of pixel electrodes. Each of the switching elements is connected to apply the signal voltage of a corresponding signal line to a corresponding pixel electrode when the switching element is driven via a corresponding scanning line. The use of the switching elements provides a high contrast image while sufficiently reducing crosstalk between adjacent pixels.

A switching element is generally formed of a thin film transistor using a semiconductor thin film of amorphous silicon. Recent progress of production technology has enabled a semiconductor thin film of polysilicon, whose mobility is higher than that of amorphous silicon, to be formed on a glass plate at low temperatures. With thin film production technology, a scanning line driver and a signal line driver may be formed together with the switching elements for pixels on the array substrate.

The demand for liquid crystal display devices with a larger screen size is currently increasing. If the liquid crystal display device has a conventional screen size of about 12 inches, signal wirings such as the scanning lines or the signal lines may be sufficiently driven by means of a single driver. The capacitive load of the signal wirings increases upon an increase in the screen size. Therefore, there is a case where the driving ability of the driver becomes insufficient due to an increase in the capacitive load. Recently, there is a trend of employing a dual-side driving system where a pair of drivers are connected to the respective ends of signal wirings in order to solve this problem. However, the existing thin film production technology is unable to uniformly form polysilicon films having excellent properties on a glass plate. Therefore, the output characteristics of the drivers are likely to be uneven on the glass plate.

Conventionally, the scanning line driver includes an output circuit provided for each scanning line and has the structure shown in FIG. 5. In the output circuit, a NOR circuit 1 selectively outputs a scanning signal SEL under the control of an output control signal SHUT. The scanning signal SEL output from the NOR circuit 1 is level-shifted by a level shifter LS and then supplied to a scanning line Y1 via inverters 2 and 3.

The level shifter LS shifts the level of the input signal the level of which may vary between respective higher and lower power source potentials YVDD and YVSS to produce an output signal the level of which may vary between respective higher and lower power source potentials YGVDD and YGVSS. The level shifter LS drives the load connected to its output terminal by a series circuit of two N-channel transistors, or, a single P-channel transistor. Since the series circuit of two N-channel transistors and the P-channel transistor have the same driving ability. It is unknown whether the output terminal is set at the higher power source potential YGVDD or the lower power source potential YGVSS immediately after supply of power. If two scanning line drivers of the aforementioned configuration may be connected to the ends of the scanning line Y1, respectively. Further, these drivers, which differ in characteristics, may set the power source potential YGVDD to one end of the scanning line Y1 and the lower power source potential YGVSS to the other end of the scanning line Y1 immediately after supply of power. In this case, a short-circuit current flows through both scanning line drivers and through the scanning line Y1. Consequently, the power source may be shut down or broken down, disabling the liquid crystal display device from operation normally.

This problem can be avoided by a protection circuit added to the inverter 3 and having a P-channel transistor 3A and an N-channel transistor 3B shown in FIG. 6. The inverter 3 has a P-channel transistor 3C connected in series with the P-channel transistor 3A between power source terminal YGVDD and the scanning line Y1, and an N-channel transistor 3D connected in series with the N-channel transistor 3B between the scanning line Y1 and power source terminal YGVSS. In this case, the level shifter LS receives the scanning signal SEL supplied without passing through the NOR circuit 1 to supply an output signal to both the gate electrodes of the P- and N-channel transistors 3C and 3D. The output control signal SHUT is supplied directly to the gate electrode of the N-channel transistor 3B and indirectly to the gate electrode of the P-channel transistor 3A via an inverter INV. With the above-described arrangement, the transistors 3A and 3B of the protection circuit are maintained nonconductive for a while upon supply of power under the control of the output control signal SHUT so that the scanning line Y1 can be set into an electrically-floating state to prevent a short-circuit current from flowing therethrough. However, the transistors 3A and 3B are required to be as large as the transistors 3C and 3D of the final inverter 3 that are the largest circuit elements in the scanning line driver. Therefore, it is extremely difficult to determine their layout without increasing the width of the frame that surrounds the display area in the liquid crystal display device.

BRIEF SUMMARY OF THE INVENTION

In view of the aforementioned problems, an object of the present invention is to provide a circuit panel and a flat-panel display device that can reduce the difficulty in layout while suppressing undesirable charges from being supplied to the signal wiring immediately after supply of power.

Another object of the present invention is to provide a circuit panel and a flat-panel display device that can effectively prevent any short-circuit current from flowing through the signal wiring immediately after supply of power.

In an aspect of the present invention, there is provided a circuit panel which comprises a signal wiring formed on an insulating substrate and an output circuit disposed at an end of the signal wiring, for supplying one of first and second voltages to the signal wiring according to an external voltage and a timing signal, wherein the output circuit includes a plurality of circuit elements whose driving abilities are uneven, to output the first voltage upon receipt of the external voltage.

In another aspect of the invention, there is provided a flat-panel display device which comprises first and second substrates and an optical modulation layer held between the substrates, wherein the first substrate includes first signal wirings, second signal wirings almost perpendicularly intersecting the first signal wirings, pixel transistors disposed near intersections of the first and second signal wirings, pixel electrodes electrically connected to the pixel transistors, and a drive circuit having an output circuit disposed at an end of at least one of the first and second signal wirings, for outputting one of first and second voltages to the signal wiring according to an external voltage and a timing signal; and wherein the output circuit has a plurality of circuit elements whose driving abilities are uneven, to output the first voltage upon receipt of the external voltage.

In still another aspect of the invention, there is provided a circuit panel which comprises a signal wiring formed on an insulating substrate and an output circuit disposed at an end of the signal wiring, for outputting one of first and second voltages to the signal wiring according to an external voltage and a timing signal, wherein the output circuit has a plurality of circuit elements whose resistances differ from each other to output the first voltage upon receipt of the external voltage.

In a further aspect of the invention, there is provided a circuit panel which comprises a signal wiring formed on an insulating substrate and an output circuit disposed at an end of the signal wiring, for determining an output voltage to be supplied to the signal wiring, according to an external voltage and a timing signal, wherein the output circuit has a plurality of circuit elements whose driving abilities are uneven to output the output voltage to the signal wiring.

With the circuit panel or flat-panel display device, the driving abilities of the circuit elements are uneven. In this structure, a desired voltage can be output to the signal wiring even if the characteristics of another circuit located upstream of the output circuit is not constant. Further, in a case where a pair of output circuits are disposed at both ends of the signal wiring, it is possible to attain high reliability whilst also preventing lowering of the manufacture yield and malfunctions due to a short-circuit current. Moreover, since the structure does not require the use of large circuit elements, the difficulty in layout can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1A:
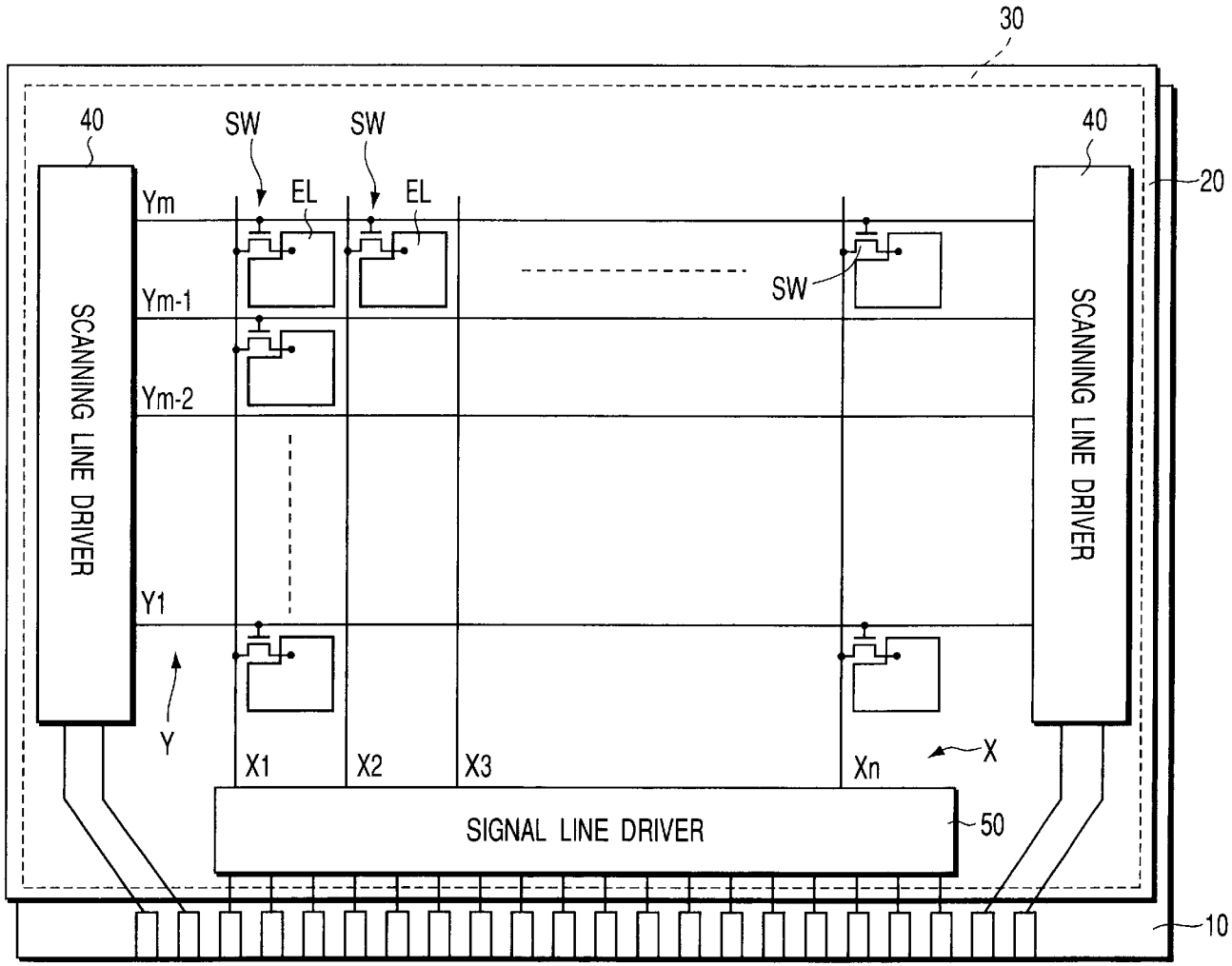
FIG. 1A is a schematic plan view showing the arrangement of a liquid crystal display device according one embodiment of the invention.
Figure 1B:
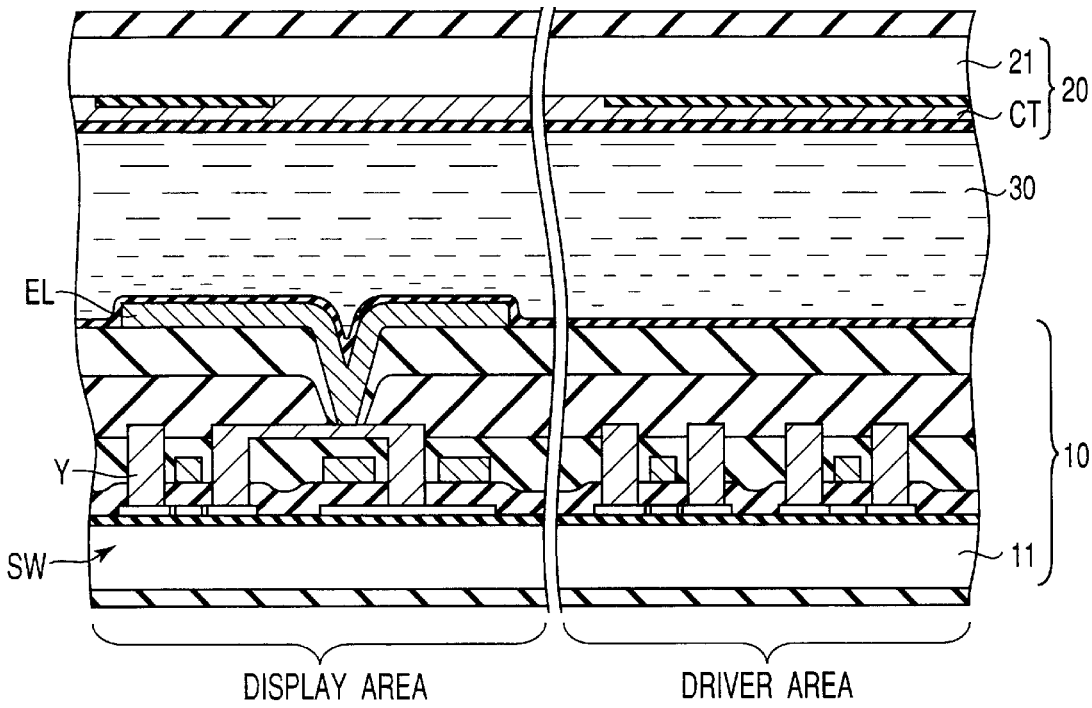
FIG. 1B is a cross-sectional view of part of the liquid crystal display device shown in FIG. 1A.

A liquid crystal display device according to an embodiment of the present invention will now be described with reference to the accompanying drawings. FIG. 1A schematically shows the arrangement of the liquid crystal display device, and FIG. 1B shows a cross-section of part of the liquid crystal display device. The liquid crystal display device is a flat-panel display device comprising an array substrate 10 in which a matrix array of pixel electrodes EL are formed over an insulating substrate 11 such as a glass plate shown in FIG. 1B and arranged within a diagonal display area of 15 inches, a counter substrate 20 in which a counter electrode CT is formed over an insulating substrate 21 such as a glass plate shown in FIG. 1B and arranged to face the pixel electrodes EL, and a liquid crystal layer 30 held between the array substrate 10 and the counter substrate 20. The array substrate 20 and The liquid crystal layer 30 is formed of a liquid crystal composition received in a cell that is surrounded and sealed by a sealing material between the array substrate 10 and the counter substrate 20, and serves as an optical modulation layer for modulating light being transmitted therethrough according to a difference between the potentials of each pixel electrode EL and the counter electrode CT.

In addition to the pixel electrodes EL, the array substrate 10 includes a plurality of scanning lines Y arranged along the rows of the pixel electrodes EL, a plurality of signal lines X arranged along the columns of the pixel electrodes EL, a plurality of pixel switching elements SW arranged near intersections of the scanning lines Y and the signal lines X, a pair of first and second scanning line drivers 40 for driving the scanning lines Y, and a signal line driver 50 for driving the signal lines X. Each switching element SW is connected to apply the potential of a corresponding signal line X to a corresponding pixel element EL when it is driven via a corresponding scanning line Y. The first and second scanning line drivers 40 and the signal line driver 50 are located in an area located outside the matrix array of the pixel electrodes EL and close to the edges of the array substrate 10 in. The first and second scanning line drivers 40 and the signal line driver 50 are integrated in the array substrate 10 using semiconductor thin films of polysilicon, just like the switching elements SW.

Figure 2:
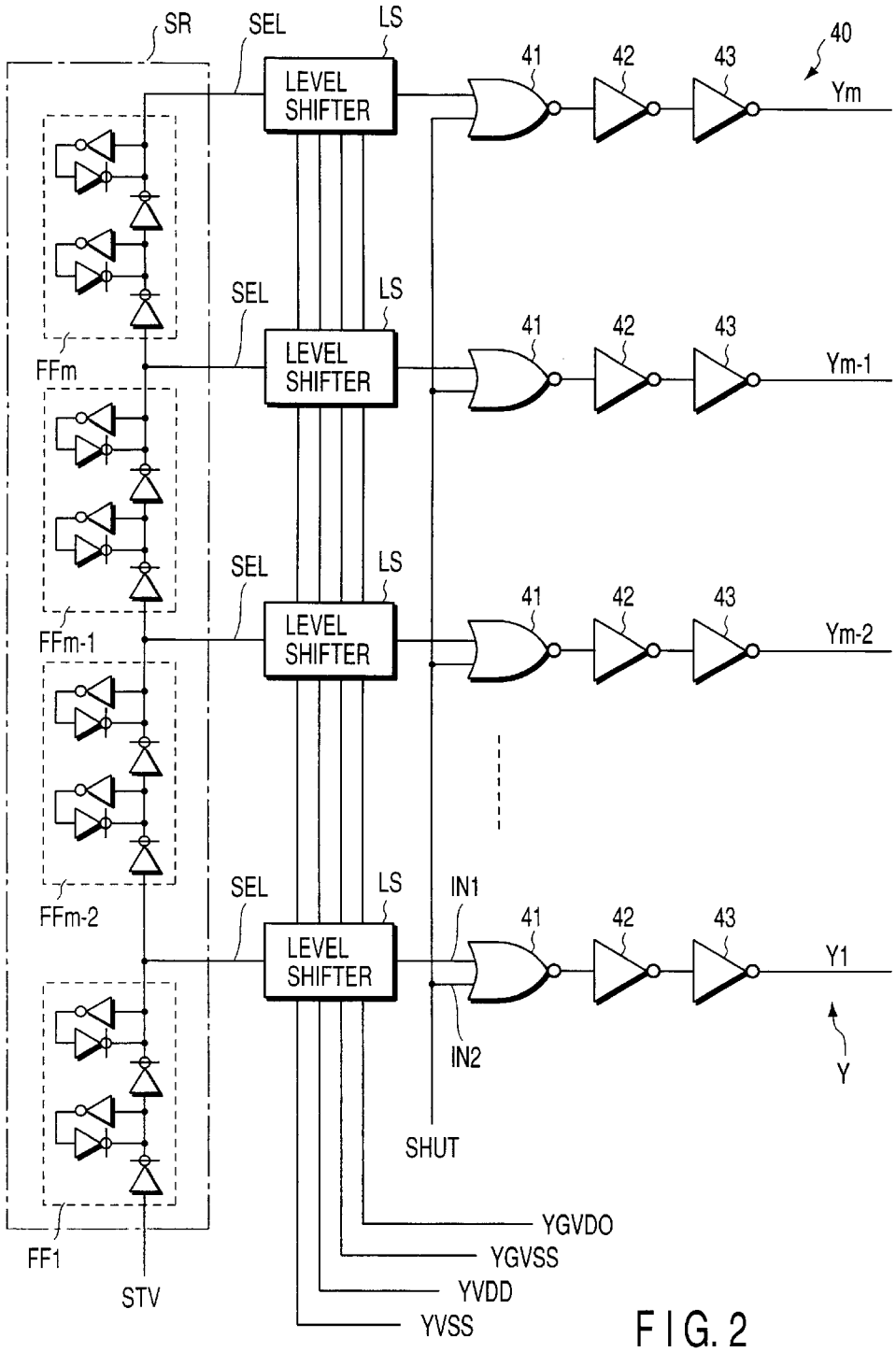
FIG. 2 is a circuit diagram showing the arrangement of each scanning line driver shown in FIG. 1A.

FIG. 2 shows the arrangement of the scanning line driver 40. The scanning line driver 40 comprises a shift register SR, a number m of level shifters LS, a number m of 2-input NOR circuits 41, a number m of inverters 42 and a number m of inverters 43. The shift register SR has a number m of flip-flops FF1 to FFm connected in cascade to sequentially latch and shift a vertical scanning start pulse STV in synchronism with a clock signal. Each of the flip-flops FF1 to FFm generates a scanning signal SEL from an output terminal thereof when the vertical scanning start pulse STV is latched. Each scanning signal SEL is supplied to a corresponding scanning line Y via a corresponding level shifter LS, NOR circuit 41, inverter 42 and inverter 43. The level shifter LS has a configuration the same as that of the conventional level shifter shown in FIG. 5, and operates such that the scanning signal SEL of an amplitude between respective higher and lower power source potentials YVDD and YVSS is level-shifted to produce a scanning signal of an amplitude between respective higher and lower power source potentials YGVDD and YGVSS. The NOR circuit 41 is controlled by an output control signal SHUT to selectively output the scanning signal SEL supplied from the level shifter LS. The output control signal SHUT is used to reset the circuit elements of the scanning line driver 40 before the vertical scanning start signal STV is input.

Figure 3:
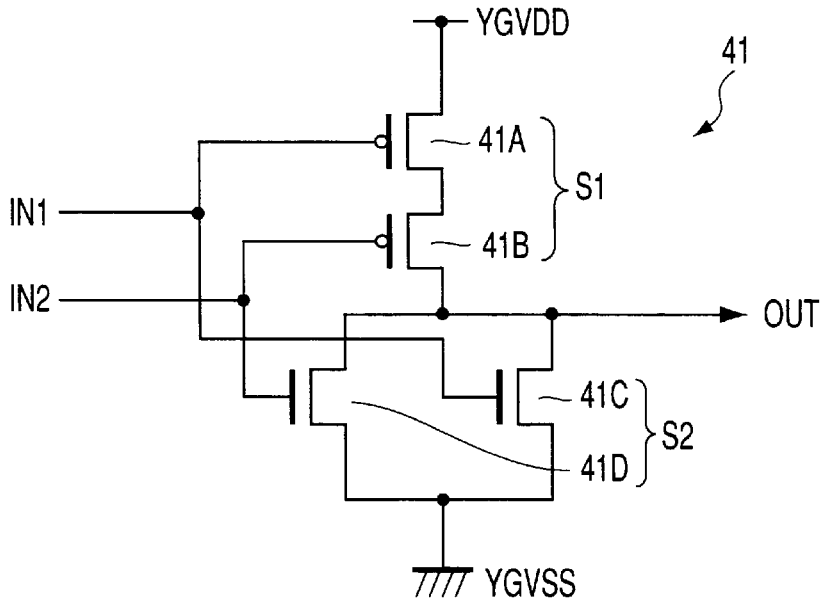
FIG. 3 is a circuit diagram showing the arrangement of a NOR circuit shown in FIG. 2.
Figure 4:
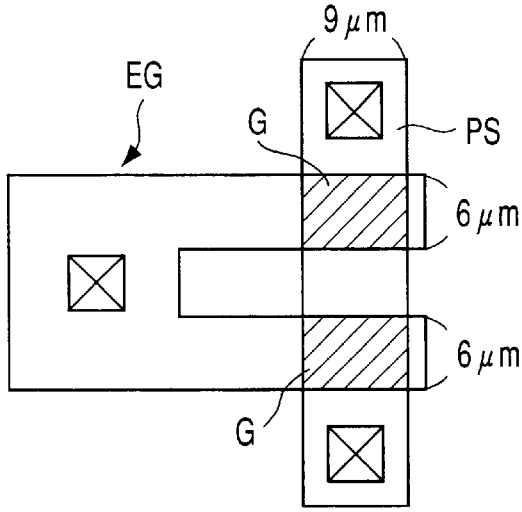
FIG. 4 is a plan view showing the dual-gate structure of transistors shown in FIG. 3.

FIG. 3 shows the arrangement of the NOR circuit 41. The NOR circuit 41 includes a switching circuit S1 of P-channel transistors 41A and 41B that are connected in series between the higher power source terminal YGVDD and the output terminal OUT and another switching circuit S2 of N-channel transistors 41C and 41D that are connected in parallel between the output terminal OUT and the lower power source terminal YGVSS. The gate electrodes of the P- and N-channel transistors 41A and 41C are connected to the input terminal IN1 for receiving the scanning signal SEL, whereas the gate electrodes of the P- and N-channel transistors 41B and 41D are connected to the input terminal IN2 for receiving the output control signal SHUT. The transistors 41A to 41D have driving abilities equal to each other and are formed in a dual gate structure as shown in FIG. 4 where a pair of gate electrodes G extend from a metal layer EG to perpendicularly intersect the semiconductor thin film PS of polysilicon and formed on the semiconductor thin film PS via a gate insulating film. Each of the gate electrodes G has a gate width W of about 9 $\mu$m and a gate length L of about 6 $\mu$m. When the transistors 41A to 41D are connected in the above-described manner, the W/L ratio of the N-channel transistors 41C and 41D is four times that of the P-channel transistors 41A and 41B. In other words, in the switching circuit S1 formed of two transistors connected in series and the switching circuit S2 formed of two transistors connected in parallel, if the transistors of the switching circuits S1 and S2 have an identical W/L ratio, the ON-resistance of the switching circuit S1 is four times that of the switching circuit S2.

Thus, since the driving ability of the switching circuit S1 is ¼ of that of the switching circuit S2, the output terminal of the NOR circuit 41 is reliably set to the lower power source potential YGVSS even if the potentials of the input terminals IN1 and IN2 are unstable immediately after supply of power.

Since there is no circuit other than the inverters 42 and 43 serving as an output buffer between the NOR circuit 41 and the scanning line Y, the potentials of the ends of the scanning line Y are commonly set to the lower potential YGVSS by the first and second scanning line drivers 40 immediately after supply of power so that the scanning line Y can rise stably without causing a short-circuit current flow.

The liquid crystal display device described above employs a dual-side driving system where the first and second scanning drivers 40 are connected to the ends of a signal wiring, and the driving abilities of the switching circuits S1 and S2 are dissimilar. With such an arrangement, even if the characteristics of the first and second scanning line drivers 40 differ from each other, the ends of the scanning line are not set to different potentials immediately after supply of power. Since no short-circuit current will flow through the scanning line Y between the first and second scanning line drivers 40, it is possible to attain high reliability whilst also preventing lowering of the manufacture yield and malfunctions due to a short-circuit current. Additionally, since the switching circuits S1 and S2 located upstream of an output buffer can be formed without requiring the use of large circuit elements, the layout can be simplified.

Figure 5:
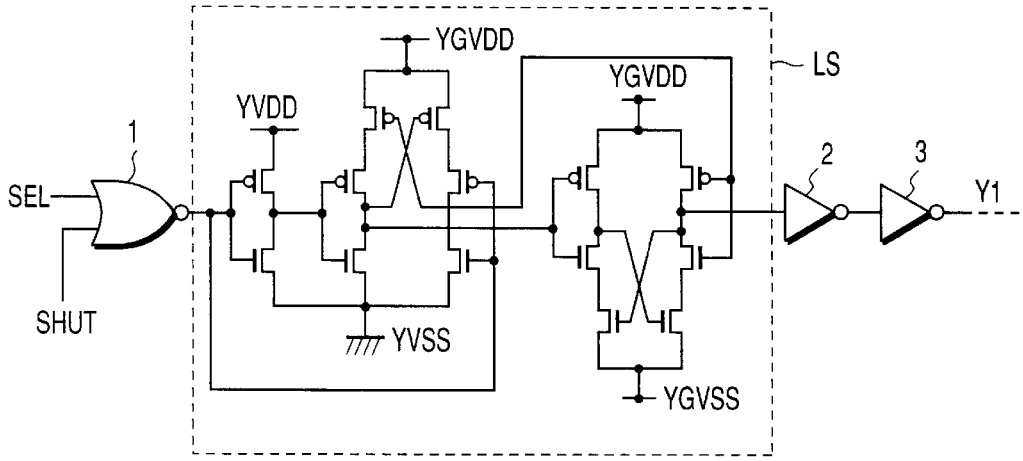
FIG. 5 (PRIOR ART)
FIG. 5 is a schematic circuit diagram of an output circuit of a conventional scanning line driver.
Figure 6:
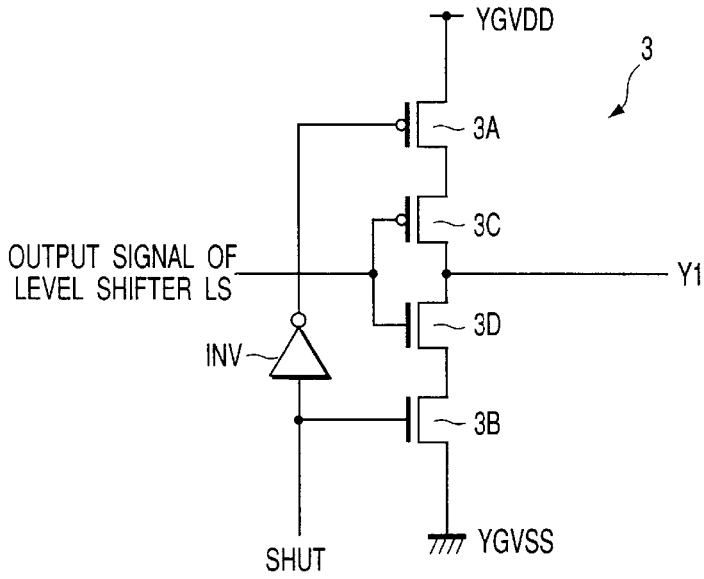
FIG. 6 (PRIOR ART)
FIG. 6 is a circuit diagram of a protection circuit added to an inverter shown in FIG. 5.

In the conventional case shown in FIG. 5, the level shifter LS is connected to the 2-input NOR circuit 1 at the downstream side thereof. Unlike the 2-input NOR circuit 41 of the above described embodiment, this level shifter LS does not have a structure in which output potential thereof is set to a specified one of the respective higher and lower power source potentials YGVDD and YGVSS immediately after supply of power. Therefore, there is a possibility that a short-circuit current flows through the scanning line whose both ends are set to different potentials immediately after supply of power, due to the pair of scanning line drivers 40 having uneven characteristics. Additionally, the size of the transistors 41A to 41D of the 2-input NOR circuit 41 is about 1/10 of that of the transistors 3A and 3B of the protection circuit added to the final inverter 3 of the conventional case shown in FIG. 3. Therefore, layout of circuitry is facilitated without requiring an increase in the width of the frame that surrounds the display area of the liquid crystal display device. The output buffer of the scanning line drivers 40 generally needs to be made larger as the resolution and the size of the liquid crystal display device are increased. In the conventional case shown in FIG. 3, the transistors 3A and 3B of the protection circuit need to be made larger accordingly. Unlike the conventional case, in the liquid crystal display device of the embodiment described above, the transistors 41A to 41D of the NOR circuit 41 need not be made larger.

In the embodiment, the W/L ratio of the N-channel transistors 41C and 41D is made four times larger than that of the P-channel transistors 41A and 41B. Instead, the former W/L ratio may be made even greater than four times of the latter so as to make the start up of the liquid crystal display device more stable.

In the embodiment described above, the transistors constituting the switching circuits S1 and S2 have the same W/L ratio. Nonetheless, they may have different W/L ratios to attain uneven driving abilities between the switching circuits S1 and S2. The ratio of the ON-resistance of the switching circuit S1 to that of the switching circuit S2 may be set at any desired value. In a case where the transistor characteristics are deviated within about 30%, it is desired that the switching circuit S1 have an ON-resistance at least three times as high as that of the switching circuit S2. In view of the timing of outputting scan signals to two adjacent scanning lines, it is desired that the switching circuit S1 have an ON-resistance at most ten times as high as that of the switching circuit S2.

As indicated above, the embodiment is a dual-side driving system in which the first and second scanning line drivers 40 are connected to the ends of each scanning line Y, respectively. Nevertheless, the present invention can be applied to another type of a dual-side driving system, in which first and second signal line drivers are connected to the ends of each signal line X, respectively.

In the embodiment above described, both ends of each signal wiring are used for receiving signals supplied thereto. According to the present invention, only one end of each signal wiring can be used for receiving a signal input thereto. In this case, the layout restrictions decrease, preventing the signal wiring from being set to an undesired potential.

The embodiment described above is a liquid crystal display. Nevertheless, the invention is limited to liquid crystal displays. Rather, the invention can be applied to any other self-emission display that has two opposing electrodes and a light-emitting layer interposed between the electrodes and serving as a light-modulating layer. For example, the invention can be applied to an organic electroluminesence display.

As described above, according to the invention, there are provided a circuit panel and a flat-panel display device that can reduce the difficulty in layout while suppressing undesirable charges from being supplied to a signal wiring immediately after supply of power, and also effectively prevent any short-circuit current from flowing through a signal wiring immediately after supply of power in a case where both ends of the signal wiring are simultaneously-driven.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A circuit panel comprising:

a signal wiring formed on an insulating substrate; and first and second output circuit sections which drive ends of the signal wiring based an input signal, each of the output circuit sections including a level-shifter which level-shifts the input signal and a logic circuit which is formed of first and second circuit elements and is configured to output a first voltage or a second voltage according to a voltage signal from the level shifter;

wherein the first and second circuit elements are configured to have uneven driving capabilities in order to set the signal wiring to the first voltage immediately after power is supplied.

2. The circuit panel according to claim 1, wherein the first and second output circuit sections are formed on the insulating substrate.

3. The circuit panel according to claim 1, each of the output circuit sections further including a buffer circuit inserted between the logic circuit and the signal wiring.

4. The circuit panel according to claim 1, wherein the first and second circuit elements are connected in series between a pair of power source terminals.

5. The circuit panel according to claim 4, wherein the first circuit element has transistors connected in series, and the second circuit element has transistors connected in parallel, and the driving abilities of said transistors are equal to each other.

6. The circuit panel according to claim 4, wherein the transistors in said first circuit element are of a conductivity type different from that of the transistors in said second circuit element.

7. The circuit panel according to claim 5, wherein said transistors have semiconductor films of polysilicon formed on said insulating substrate.

8. The circuit panel according to claim 5, wherein said first circuit element has an ON-resistance three to ten times as high as that of the second circuit element.

9. A flat-panel display device comprising:

first and second substrate; and an optical modulation layer held between said first and second substrate;

wherein said first substrate includes first signal wirings, second signal wirings almost perpendicularly intersecting said first signal wirings, pixel transistors disposed near intersections of said first and second signal wirings, pixel electrodes electrically connected to said pixel transistors, and a driving circuit for the first and second signal wirings, said driving circuit including first and second output circuit sections which drive ends of each first signal wiring based on an input signal, each of the output circuits sections including a level shifter which level-shifts the input signal and a logic circuit which is formed of first and second circuit elements and is configured to output a first voltage or a second voltage according to a voltage signal from the level shifter;

wherein the first and second circuit elements are configured with uneven driving capabilities in order to set the signal wiring to the first voltage immediately after power is supplied.

10. The flat-panel display device according to claim 9, wherein each of the output circuit sections further includes a buffer circuit is inserted between the logic circuit and the signal wiring.

11. The flat-panel display device according to claim 9, wherein the first and second circuit elements are connected in series between a pair of power source terminals.

12. The flat-panel display device according to claim 11, wherein the first circuit element has transistors connected in series, and the second circuit element has transistors connected in parallel, and the driving abilities of said transistors are equal to each other.

13. The flat-panel display device according to claim 11, wherein the transistors in the first circuit element are of a conductivity type different from that of the transistors in the second circuit element.

14. The flat-panel display device according to claim 12, wherein said transistors have semiconductor films of polysilicon formed on said insulating substrate.

15. A circuit panel comprising:

a signal wring formed on an insulating substrate; and first and second output circuit sections which drive ends of the signal wiring according to an input signal, each of the output circuit sections including a level shifter which level-shifts the input signal and a logic circuit which is formed of first and second circuit elements and is configured to output one a first voltage or a second voltage according to a voltage signal from the level shifter, wherein the first and second circuit elements are configured with different resistances from each other in order to set the signal wiring to the first voltage immediately after power is supplied.

16. The circuit panel according to claim 15, wherein the first and second output circuit sections are formed on said insulating substrate.

17. A circuit panel comprising:

a signal wiring formed on an insulating substrate; and first and second output circuit sections which drive ends of the signal wiring according to an external voltage and an output control signal, each of the output circuit sections including a level-shifter which level-shifts the external voltage and a logic circuit which is formed of first and second circuit elements and is controlled by the output control signal to output a first voltage or a second voltage according to a voltage signal from the level shifter;

wherein the first and second circuit elements are configured with uneven driving capabilities in order to set the signal wiring to the first voltage immediately after power is supplied.

18. The circuit panel according to claim 17, wherein the first and second output circuit sections are formed on said insulating substrate.

* * * * *